US005370552A

United States Patent [19]

Chishima et al.

[11] Patent Number: 5,370,552

[45] Date of Patent: Dec. 6, 1994

[54] ELECTRICAL CONNECTOR

[75] Inventors: Masamitsu Chishima; Kazuhito Saka; Kenji Mizutani, all of Yokkaichi, Japan

[73] Assignee: Sumitomo Wiring Systems, Ltd., Yokkaichi, Japan

[21] Appl. No.: 115,047

[22] Filed: Sep. 1, 1993

[30] Foreign Application Priority Data

Sep. 16, 1992 [JP] Japan ..... 4-064512[U]
Sep. 21, 1992 [JP] Japan ..... 4-065593[U]

[51] Int. Cl.[5] ..... H01R 9/07
[52] U.S. Cl. ..... 439/495; 439/67
[58] Field of Search ..... 439/326–328, 439/492–499, 67, 77, 329

[56] References Cited

U.S. PATENT DOCUMENTS

| | | | |
|---|---|---|---|
| 3,336,565 | 8/1967 | Crimmins | 439/495 |
| 4,695,108 | 9/1987 | Ichitsubo | 439/495 |
| 4,734,053 | 3/1988 | Imai . | |
| 4,900,268 | 2/1990 | Kunishi | 439/495 |
| 4,969,840 | 11/1990 | Ii et al. . | |
| 5,110,305 | 5/1992 | Edgely et al. | 439/495 |
| 5,176,535 | 1/1993 | Redmond et al. | 439/495 |
| 5,213,534 | 5/1993 | Gardner et al. | 439/495 |

FOREIGN PATENT DOCUMENTS

| | | |
|---|---|---|
| 0259964 | 3/1988 | European Pat. Off. . |
| 0388216 | 9/1990 | European Pat. Off. . |

OTHER PUBLICATIONS

United Kingdom Search Report dated Jan. 31, 1994.

*Primary Examiner*—David L. Pirlot
*Attorney, Agent, or Firm*—Sandler, Greenblum & Bernstein

[57] ABSTRACT

An electrical connector comprising: a terminal including a contact piece; a housing; a slider including a pressing portion; a flexible cable including an end conductor; and a reinforcing plate having a pressed face to be pressed by a pressing face of the pressing portion of the slider; wherein after the slider has been temporarily engaged with the housing in which the terminal is accommodated, the end conductor of the flexible cable is inserted together with the reinforcing plate into the housing and then, the slider is displaced to a full engaging position such that the end conductor of the flexible cable is brought into pressing contact with the contact piece of the terminal through the reinforcing plate by the pressing portion of the slider; wherein the pressed face of the reinforcing plate is formed obliquely such that the reinforcing plate becomes thinner from a front edge of the reinforcing plate towards a rear edge of the reinforcing plate, while the pressing face of the pressing portion of the slider is formed obliquely such that the slider becomes thicker from a front edge of the slider towards a rear edge of the slider.

2 Claims, 7 Drawing Sheets

ELECTRICAL CONNECTOR

BACKGROUND OF THE INVENTION

The present invention relates to an electrical connector in which force for holding a flexible cable is increased.

In a known electrical connector, a slider 3 having a pressing portion 3*a* is temporarily engaged with a housing 2 in which a terminal 1 is accommodated and an end conductor 4*a* of a flexible cable 4 is inserted into the housing 2 together with a reinforcing plate 5 as shown in FIG. 2. Then, as shown in FIG. 1, the slider 3 is depressed to a full engaging position such that the end conductor 4*a* of the flexible cable 4 is brought into pressing contact with a contact piece 1*a* of the terminal 1 through the reinforcing plate 4 by the pressing portion 3*a* of the slider 3.

However, holding of the flexible cable 4 depends upon contact pressure of the terminal 1 relative to the flexible cable 4. Thus, if the number of poles of the terminal 1 is large, force for holding the flexible cable 4 increases. On the contrary, if the number of poles of the terminal 1 is small, force for holding the flexible cable 4 decreases. Hence, the known electrical connector has such drawbacks that the flexible cable 4 is readily detached from the housing 2 and improper contact between the end conductor 4*a* of the flexible cable 4 and the terminal 1 is likely to take place. Furthermore, in the known electrical connector, since space for inserting the flexible cable 4 into the housing 2 is narrow, operation for inserting the flexible cable 4 into the housing 2 is troublesome.

SUMMARY OF THE INVENTION

Accordingly, an essential object of the present invention is to provide, with a view to eliminating the inconveniences inherent in conventional electrical connectors, an electrical connector in which force for holding a flexible cable is increased so as to prevent the flexible cable from being readily detached from a housing such that reliability of connection between the flexible cable and a terminal is raised.

Another important object of the present invention is to provide an electrical connector in which the flexible cable can be inserted into the housing easily.

In order to accomplish these objects of the present invention, an electrical connector embodying the present invention comprises: a terminal which includes a contact piece; a housing; a slider which includes a pressing portion having a pressing face; a flexible cable which includes an end conductor; and a reinforcing plate which has a pressed face to be pressed by the pressing face of the pressing portion of the slider; wherein after the slider has been temporarily engaged with the housing in which the terminal is accommodated, the end conductor of the flexible cable is inserted together with the reinforcing plate into the housing and then, the slider is displaced to a full engaging position such that the end conductor of the flexible cable is brought into pressing contact with the contact piece of the terminal through the reinforcing plate by the pressing portion of the slider; wherein the pressed face of the reinforcing plate is formed obliquely such that the reinforcing plate becomes thinner from a front end of the reinforcing plate towards a rear end of the reinforcing plate, while the pressing face of the pressing portion of the slider is formed obliquely such that the slider becomes thicker from a front end of the slider towards a rear end of the slider.

In the electrical connector of the present invention, the pressed face of the reinforcing plate is formed obliquely such that the reinforcing plate becomes thinner from the front end of the reinforcing plate towards the rear end of the reinforcing plate, while the pressing face of the pressing portion of the slider is formed obliquely such that the slider becomes thicker from the front end of the slider towards the rear end of the slider.

Therefore, when the flexible cable is inserted together with the reinforcing plate into the housing after the slider has been temporarily engaged with the housing, gap between the contact piece of the slider and the pressing face of the pressing portion of the slider becomes wider and thus, the flexible cable can be easily inserted into the housing.

Meanwhile, when the slider has been depressed to the full engaging position, the pressed face of the reinforcing plate and the pressing face of the pressing portion of the slider are obliquely brought into contact with each other and thus, frictional force therebetween is increased in comparison with an arrangement in which both the pressed face of the reinforcing plate and the pressing face of the pressing portion of the slider are formed horizontally. Furthermore, if the flexible cable is pulled in a direction for detaching the flexible cable from the housing, the pressed face of the reinforcing plate holds onto the pressing face of the pressing portion of the slider, so that contact pressure therebetween is increased, thereby resulting in increase of force for holding the flexible cable. Therefore, the flexible cable is prevented from being readily detached from the housing.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
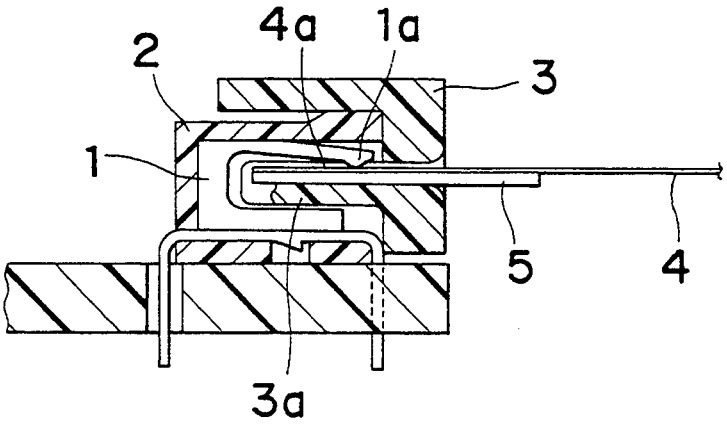
Fig. 1 PRIOR ART
FIG. 1 is a sectional view of a prior art electrical connector in which a slider is disposed at a full engaging position (already referred to)
Figure 2:
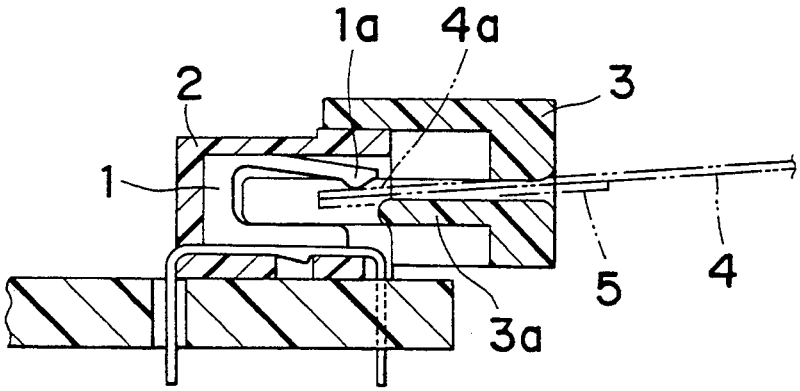
Fig. 2 PRIOR ART
FIG. 2 is a sectional view of the prior art electrical connector of FIG. 1, in which the slider is disposed at a temporary engaging position (already referred to)
Figure 3:
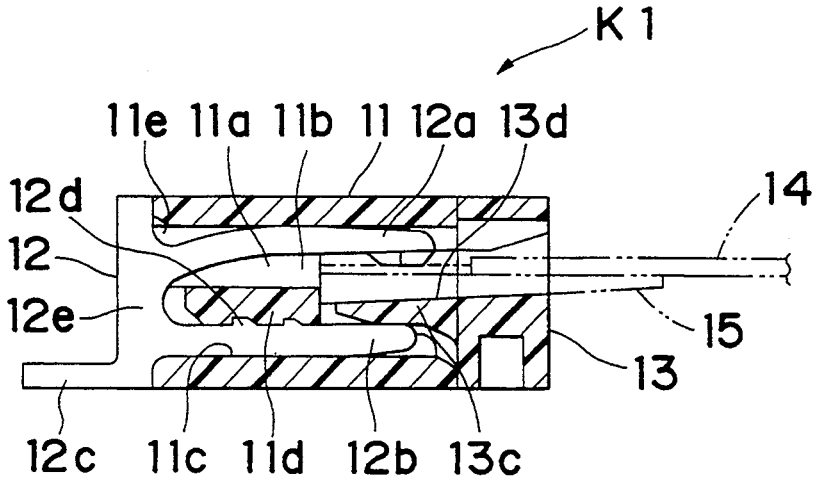
FIG. 3 is a sectional view of an electrical connector according to a first embodiment of the present invention, in which a slider is disposed at a full engaging position.
Figure 4:
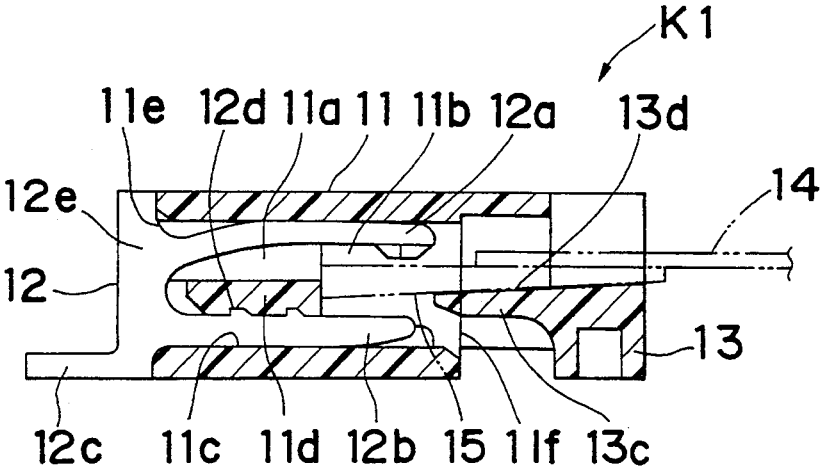
FIG. 4 is a sectional view of the electrical connector of FIG. 3, in which the slider is disposed at a temporary engaging position.
Figure 5:
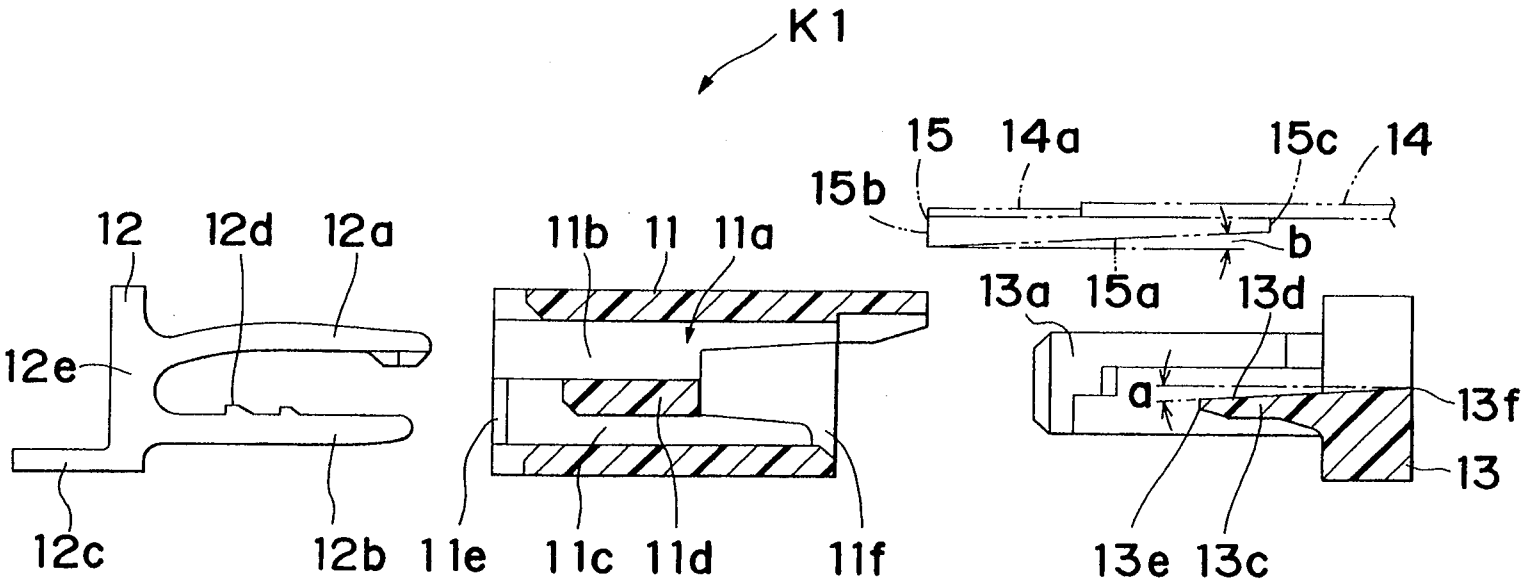
FIG. 5 is a partly sectional exploded side elevational view of the electrical connector of FIG. 3.
Figure 6:
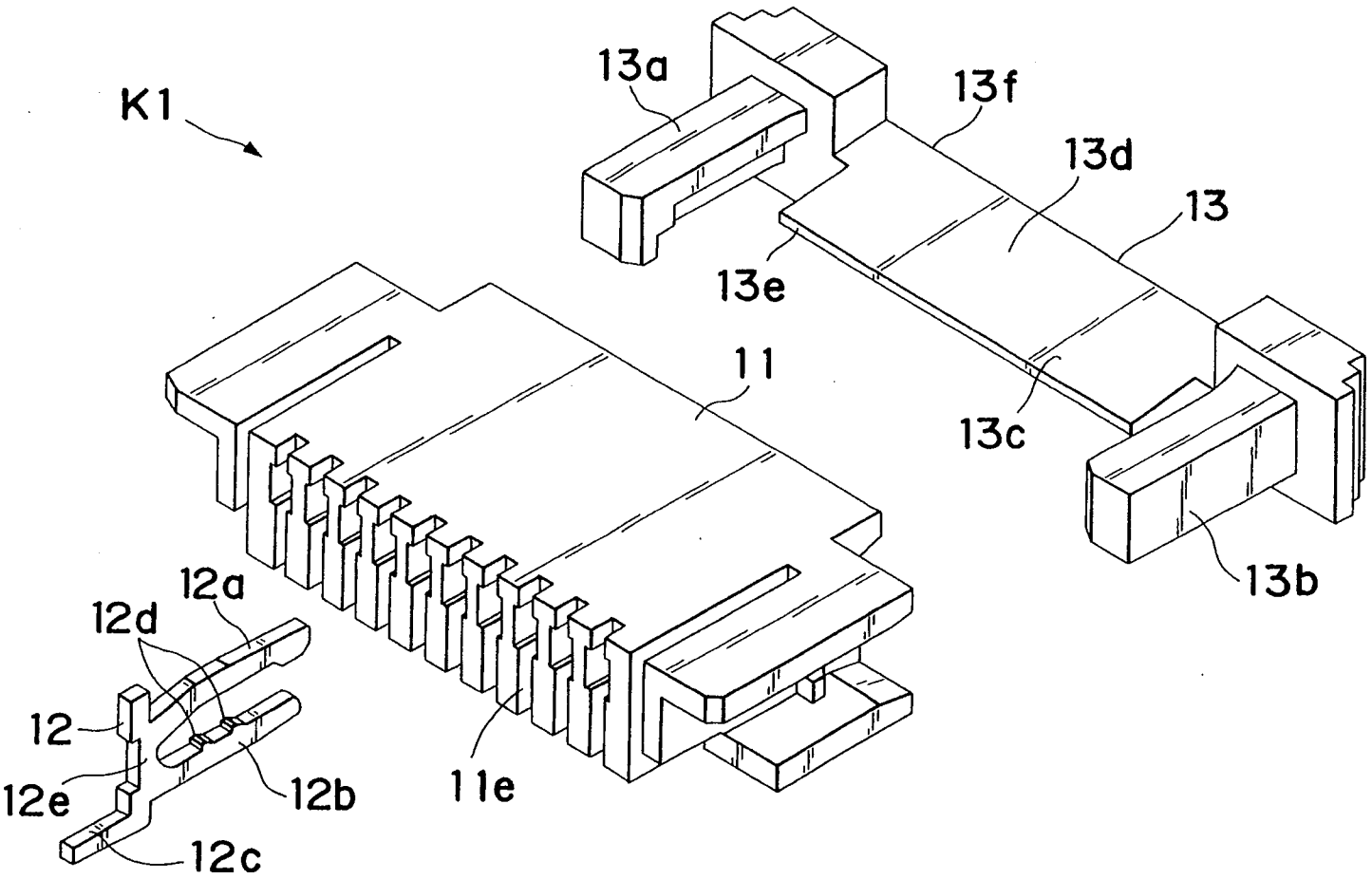
FIG. 6 is an exploded perspective view of the electrical connector of FIG. 3.

Referring now to the drawings, there is shown in FIGS. 3 to 6, an electrical connector K1 according to a first embodiment of the present invention. As shown in FIGS. 5 and 6, the electrical connector K1 includes a housing 11 made of synthetic resin. A plurality of slots 11*a* for receiving metallic terminals 12, respectively are formed on the housing 11 at a predetermined interval in a longitudinal direction of the housing 11. A contact piece recess 11*b* and a positioning piece recess 11*c* are formed on each of a pair of opposed walls defining each of the slots 11*a* and are separated from each other by a partition wall 11*d*.

In the terminal 12 formed by a forked sheet, a contact piece 12*a* and a positioning piece 12*b* project horizontally substantially in parallel with each other from a front face of a vertical coupling portion 12*e*, while a lead piece 12*c* is formed at a lower end of a rear face of the coupling portion 12*e*. When the contact piece 12*a* and the positioning piece 12*b* of the terminal 12 have been, respectively, inserted into the contact piece recess 11*b* and the positioning piece recess 11*c* from a rear inlet 11*e* of each of the slots 11*a*, two locking projections 12*d* formed on the positioning piece 12*b* of the terminal 12 hold onto a lower face of the partition wall 11*d* so as to prevent the terminal 12 from being detached from the housing 11 and thus, the terminal 12 is secured in the slot 11*a* as shown in FIG. 4.

On the other hand, the slider 13 is made of synthetic resin and includes opposite end portions 13*a* and 13*b* and a pressing portion 13*c* for coupling the end portions 13*a* and 13*b*. The end portions 13*a* and 13*b* are adapted to be engaged with opposite outer end faces of the housing 11, respectively. A pressing face 13*d* is formed on an upper face of the pressing portion 13*c* and the pressing portion 13*c* has a front end 13*e* edge a rear edge 13*f*. The pressing face 13*d* of the pressing portion 13*c* is formed obliquely such that the pressing portion 13*c* becomes thicker from the front edge 13*e* towards the rear edge 13*f*. An angle a (FIG. 5) of inclination of the pressing face 13*d* preferably ranges from 3° to 7°. If the angle a of inclination of the pressing face 13*d* is smaller than 3°, force for holding a flexible cable 14 to be described later is reduced. On the contrary, when the angle a of inclination of the pressing face 13*d* exceeds 7°, the flexible cable 14 is required to be inserted into the housing 11 obliquely.

The flexible cable 14 includes a conductor gripped between upper and lower insulating films. At a distal end portion of the flexible cable 14, the upper insulating film is cut off so as to expose an end conductor 14*a*. An upper face of a reinforcing plate 15 made of synthetic resin is held in contact with a lower face of the lower insulating film. The reinforcing plate 15 has a front edge 15*b* and a rear edge 15*c*. A lower face 15*a* of the reinforcing plate 15, which is pressed by the pressing face 13*d* of the pressing portion 13*c*, is formed obliquely such that the reinforcing plate 15 becomes thinner from the front edge 15*b* towards the rear edge 15*c*. An angle b (FIG. 5) of inclination of the lower face 15*a* preferably ranges from 3° to 7° on the same grounds as those of the angle a of inclination of the pressing face 13*d* of the slider 13.

By the above described arrangement of the electrical connector K1, the terminal 12 is initially inserted into the slot 11*a* from the rear inlet 11*e* so as to be secured in the slot 11*a*. Then, the opposite end portions 13*a* and 13*b* of the slider 13 are slightly engaged with the opposite outer end faces of the housing 11, respectively such that the slider 13 is temporarily engaged with the housing 11 as shown in FIG. 4.

In this temporary engaging state of the slider 13, the end conductor 14*a* of the flexible cable 14 is inserted together with the reinforcing plate 15 into the housing 11 from a front inlet 11*f*. At this time, since the pressing face 13*d* of the pressing portion 13*c* of the slider 13 is inclined downwardly towards the front edge 13*e*, gap between the pressing face 13*d* and the contact piece 12*a* of the terminal 12 is increased in comparison with those of conventional electrical connectors and thus, the flexible cable 14 can be easily inserted into the housing 11.

Subsequently, the slider 13 is further depressed so as to be fully engaged with the housing 11 as shown in FIG. 3. At this full engaging position of the slider 13, the end conductor 14*a* of the flexible cable 14 is brought into pressing contact with the contact piece 12*a* of the terminal 12 through the reinforcing plate 15 by the pressing portion 13*c* of the slider 13. At this time, since the lower face 15*a* of the reinforcing plate 15 and the pressing face 13*d* of the slider 13 are obliquely brought into contact with each other, frictional force therebetween is increased in comparison with those of known electrical connectors in which both the lower face of the reinforcing plate and the pressing face of the slider are horizontally brought into contact with each other.

When the flexible cable 14 is pulled for some reason or other in a direction for detaching the flexible cable 14 from the housing 11, the lower face 15*a* of the reinforcing plate 15 which is thicker towards the front edge 15*b* holds onto the pressing face 13*a* of the slider 13 which is thicker towards the rear edge 13*f* and thus, contact pressure between the lower face 15*a* of the reinforcing plate 15 and the pressing face 13*a* of the slider 13 is increased. Therefore, as the flexible cable 14 is pulled powerfully more and more in the direction for detaching the flexible cable 14 from the housing 11, contact pressure between the lower face 15*a* of the reinforcing plate 15 and the pressing face 13*a* of the slider 13 is raised further, so that force for holding the flexible cable 14 is increased. As a result, the flexible cable 14 is prevented from being readily detached from the housing 11.

As is clear from the foregoing description of the electrical connector K1, the lower face of the reinforcing plate is formed obliquely such that the reinforcing plate becomes thinner from the front edge towards the rear edge, while the pressing face of the pressing portion of the slider is formed obliquely such that the slider becomes thicker from the front edge towards the rear edge. Therefore, in the electrical connector K1, when the slider is temporarily engaged with the housing and the flexible cable is inserted together with the reinforcing plate into the housing, gap between the contact piece of the terminal and the pressing face of the pressing portion is increased and thus, the flexible cable can be inserted into the housing easily.

Meanwhile, in the electrical connector K1, when the slider has been depressed to the full engaging position, the lower face of the reinforcing plate and the pressing face of the pressing portion of the slider are obliquely brought into contact with each other, so that frictional force therebetween is increased in comparison with that of an arrangement in which both the lower face of the reinforcing plate and the pressing face of the pressing portion of the slider are horizontally brought into contact with each other. Furthermore, when the flexible cable is pulled in the direction for detaching the flexible cable from the housing, the lower face of the reinforcing plate holds onto the pressing face of the pressing portion of the slider, so that contact pressure between the lower face of the reinforcing plate and the pressing face of the pressing portion of the slider is increased and thus, force for holding the flexible cable is increased. As a result, the flexible cable is advantageously prevented from being readily detached from the housing.

Figure 7:
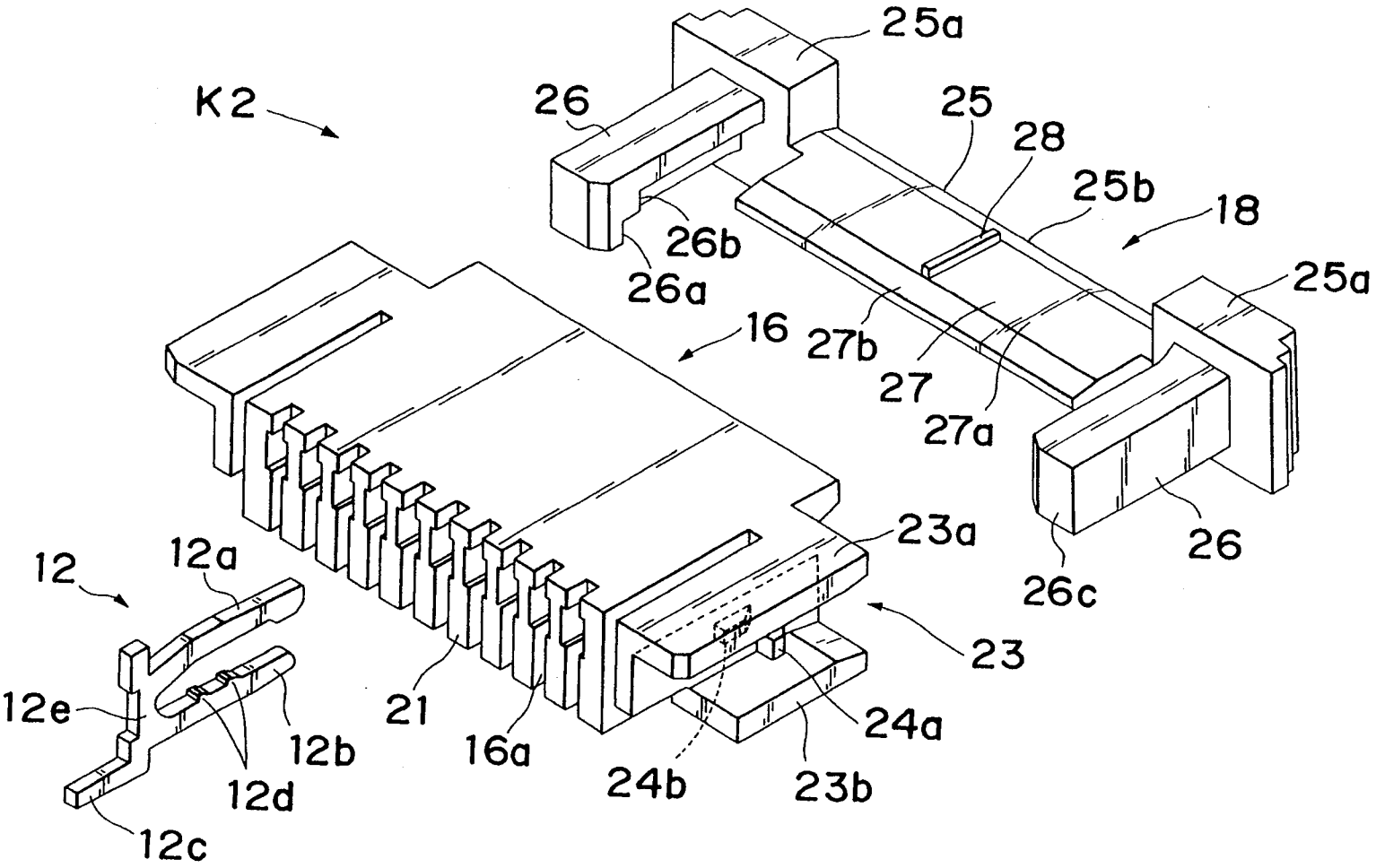
FIG. 7 is an exploded perspective view of an electrical connector according to a second embodiment of the present invention.

FIGS. 7 to 10*b* show an electrical connector K2 according to a second embodiment of the present invention. As shown in FIG. 7, the metallic forked terminal 12 is inserted into one side of a housing 16 made of synthetic resin acting as insulating material, while a slider 18 made of synthetic resin is inserted together with a flat cable 19 (FIG. 9*a*) into the other side of the housing 16 such that the flat cable 19 and the terminal 12 are brought into elastic contact with each other by the slider 18.

Figure 10A:
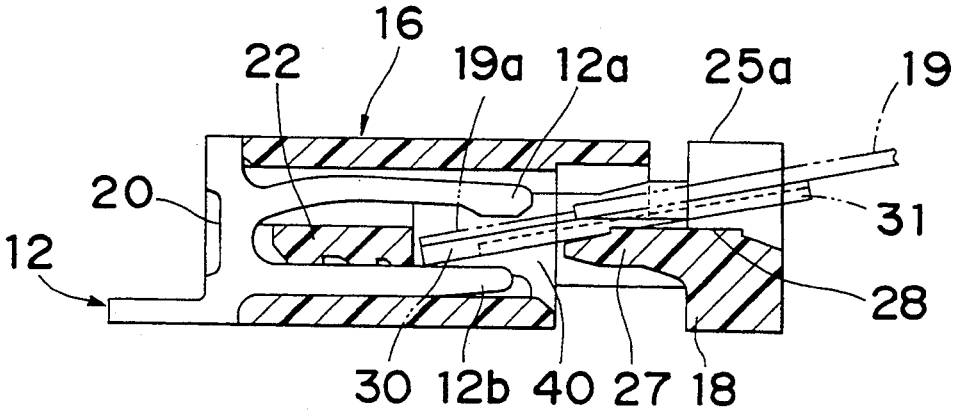
FIGS. 10*a* and 10*b* are views indicative of steps of assembly of the flat cable of FIG. 9*a*.

As shown in FIG. 10*a*, a plurality of slots 20 for receiving the terminals 12, respectively are arranged in a longitudinal direction of the housing 16. To this end, a plurality of vertical partition walls 21 are provided at a predetermined interval at a side of a rear inlet 16*a* of each of the slots 20 and a horizontal partition wall 22 is provided in each of the slots 20. The housing 16 further has a front inlet 40 (FIG. 10*a*) communicating with the slots 20. Meanwhile, a pair of mounting portions 23 are provided at opposite ends of the housing 16, respectively and each of the mounting portions 23 includes upper and lower grip pieces 23*a* and 23*b* for holding the slider 18. A temporary engaging projection 24*a* and a full engaging projection 24*b* are formed between the upper and lower grip pieces 23*a* and 23*b*.

Figure 8A:
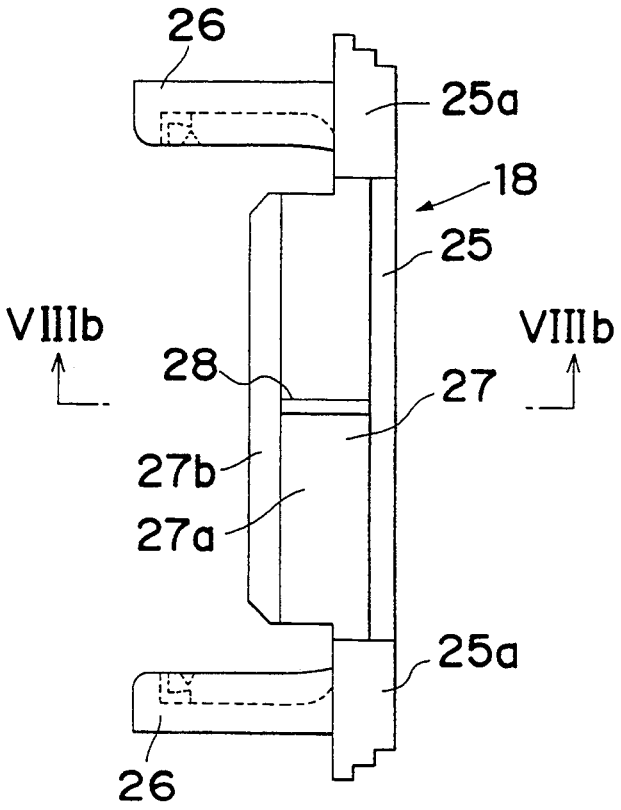
FIG. 8*a* is a top plan view of a slider of the electrical connector of FIG. 7.
Figure 8B:
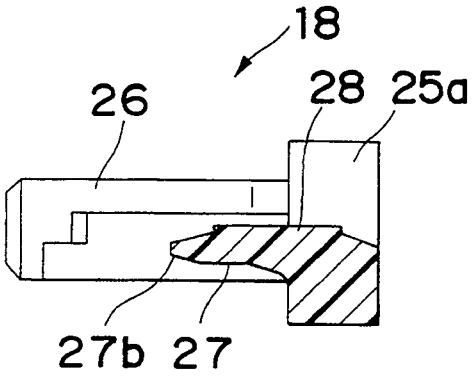
FIG. 8*b* is a sectional view taken along the line VIIIb—VIIIb in FIG. 8*a;*

As shown in FIG. 8*a*, the slider 18 has a substantially U-shaped construction and includes an elongated base plate 25. In FIG. 7, a pair of opposite end portions 25*a* extend upwardly from opposite ends of the base plate 25, respectively. A holding portion 26 extends forwardly from a front face of each of the end portions 25*a*, while a sheetlike pressing portion 27 is provided at a middle portion 25*b* of the slider 18 between the end portions 25*a* so as to project forwardly from the middle portion 25*b*. The pressing portion 27 projecting from the middle portion 25*b* has a pressing face 27*a* flush with an upper face of the middle portion 25*b* and a distal end portion 27*b* extending obliquely downwardly from a front edge of the pressing face 27*a*. A boss 28 engageable with the flat cable 19 is provided at a substantially central portion of the upper face 27*a* so as to project upwardly from the front edge to a rear edge of the pressing face 27*a*.

Meanwhile, a temporary engaging recess 26*a* and a full engaging recess 26*b* are formed inside the holding portion 26 of the slider 18. When the holding portion 26 of the slider 18 is inserted between the grip pieces 23*a* and 23*b* of the housing 16, the temporary engaging projections 24*a* and 24*b* are, respectively, engaged with the temporary engaging recess 24*a* and the full engaging recess 24*b* of the housing 16 so as to set the slider 18 to a temporary engaging position and a full engaging position of the slider 18.

Figure 9A:
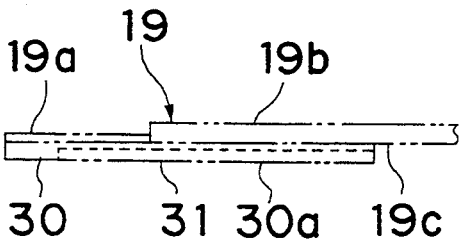
FIG. 9*a* is a side elevational view of a flat cable of the electrical connector of FIG. 7.
Figure 9B:
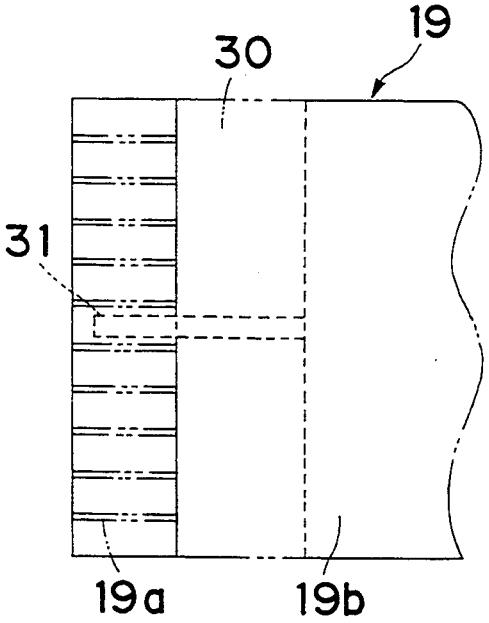
FIG. 9*b* is a top plan view of FIG. 9*a*.

As shown in FIG. 9*a*, the flat cable 19 includes a plurality of conductors 19*a* arranged at a predetermined interval. The conductors 19*a* are gripped between upper and lower insulating films 19*b* and 19*c*. At a distal end portion of the flat cable 19, the upper insulating film 19*b* is cut off through a predetermined length so as to expose the conductors 19*a*. Meanwhile, a reinforcing plate 30 having a width equal to that of the lower insulating film 19*c* is secured to a lower face of the lower insulating film 19*c* so as to extend through a predetermined length from a distal end of the lower insulating film 19*c*. The reinforcing plate 30 is formed by a flat plate made of insulating material. A groove 31 is formed at a substantially central portion of a lower face 30*a* of the reinforcing plate 30 so as to extend from a location spaced a predetermined distance from a front edge of the reinforcing plate 30 to a rear edge of the reinforcing plate 30. The groove 31 is disposed so as to confront the boss 28 of the slider 18. The lower face 30*a* of the reinforcing plate 30 is pressed by the pressing face 27*a* of the pressing portion 27 of the slider 18.

Figure 10B:
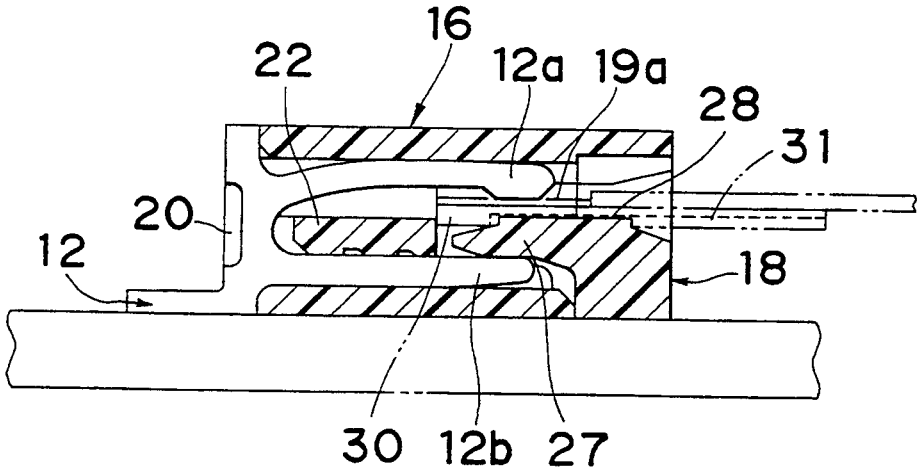

Then, assembly steps of the electrical connector K2 of the above described arrangement are described with reference to FIGS. 10*a* and 10*b*. Initially, after the terminal 12 has been inserted into each of the slots 20 of the housing 16 from the rear inlet 16*a* as shown in FIG. 10*a*, the slider 18 and the flat cable 19 are inserted into the housing 16 from the front inlet 40. Namely, the temporary engaging boss 24*a* of the housing 16 is engaged with the temporary engaging recess 26*a* of the holding portion 26 of the slider 18 and a front face 26*c* (FIG. 7) of the holding portion 26 is brought into contact with the full engaging projection 24*b* such that the slider 18 is temporarily engaged with the housing 16. In this temporary engaging state of the slider 18, the reinforcing plate 30 of the flat cable 19 is inserted, along the pressing face 27*a* of the pressing portion 27, between the contact piece 12*a* and the positioning piece 12*b* of the terminal 12 inserted into the housing 16. At this time, since the boss 28 of the pressing portion 27 of the slider 18 is disposed so as to confront the groove 31 of the reinforcing plate 30 of the flat cable 19, the boss 28 is fitted into the groove 31 so as to guide the reinforcing plate 30.

Subsequently, by depressing the slider 18 to the full engaging position, the slider 18 is displaced while the boss 28 is slid up to a front end of the groove 31. Meanwhile, by this displacement of the slider 18, the downwardly inclined distal end portion 27*b* of the pressing portion 27 is inserted between the contact piece 12*a* and the positioning piece 12*b* of the terminal 12, so that the flat cable 19 is pushed upwardly by the pressing face 27*a* of the pressing portion 27 so as to be brought into pressing contact with the contact piece 17*a* and thus, the slider 18 is set in the full engaging state as shown in FIG. 10*b*.

In the full engaging state of the slider 18 in the electrical connector K2, since the boss 28 of the pressing portion 27 of the slider 18 is engaged with the groove 31 of the reinforcing plate 30 of the flat cable 19, the flat cable 19 can be prevented from being detached from the housing 16 even if pulling force for detaching the flat cable 19 from the housing 16 is applied to the flat cable 19.

Meanwhile, the electrical connector K2 is not restricted to the above described arrangement. For example, the pressing portion 27 and the reinforcing plate 30 may have a plurality of the bosses 28 and a plurality of the grooves 31, respectively such that force of engagement between the pressing portion 27 and the reinforcing plate 30 is increased.

As will seen from the foregoing of the electrical connector K2, the boss of the pressing portion of the slider is brought into engagement with the groove of the reinforcing plate of the flat cable. Therefore, even if pulling force for detaching the flat cable from the housing is applied to the flat cable, the boss of the pressing portion is brought into contact with the front end of the groove and thus, the flat cable can be prevented from being detached from the housing.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An electrical connector comprising:

a terminal including a contact piece;

a housing for accommodating said terminal;

a slider including a pressing portion having an obliquely formed pressing face;

a flexible cable including an end conductor; and a reinforcing plate having an obliquely formed pressed face to be pressed by the pressing face of the pressing portion of the slider;

wherein after the slider has been temporarily engaged with the housing in which the terminal is accommodated, the end conductor of the flexible cable is inserted together with the reinforcing plate into the housing and thereafter, the slider is displaced to a full engaging position such that the end conductor of the flexible cable is brought into pressing contact with the contact piece of the terminal through the reinforcing plate by the pressing portion of the slider;

wherein the pressed face of the reinforcing plate is formed obliquely such that the reinforcing plate becomes thinner from a front edge of the reinforcing plate towards a rear edge of the reinforcing plate, and the pressing face of the pressing portion of the slider is formed obliquely such that the slider becomes thicker from a front edge of the slider towards a rear edge of the slider.

2. An electrical connector comprising:

a terminal including a contact piece;

a housing for accommodating said terminal;

a slider including a pressing portion having a pressing face;

a flexible cable including an end conductor; and a reinforcing plate having a pressed face to be pressed by the pressing face of the pressing portion of the slider;

wherein after the slider has been temporarily engaged with the housing in which the terminal is accommodated, the end conductor of the flexible cable is inserted together with the reinforcing plate into the housing and thereafter, the slider is displaced to a full engaging position such that the end conductor of the flexible cable is brought into pressing contact with the contact piece of the terminal through the reinforcing plate by the pressing portion of the slider;

wherein the pressing portion of the slider is provided with a boss and the reinforcing plate is formed with a groove such that the boss of the pressing portion is engaged with the groove of the reinforcing plate.

* * * * *